US005661917A

United States Patent [19]

Marchetta et al.

[11] Patent Number: 5,661,917

[45] Date of Patent: Sep. 2, 1997

[54] CIVIL ENGINEERING WORKS MACHINE IN WHICH THE WORKING TOOL IS MOUNTED AT THE END OF AN ARTICULATED ARM

[75] Inventors: Henri Marchetta, Sevrier; Georges Charles, Limas, both of France

[73] Assignee: Mecalac, Annecy le Vieux, France

[21] Appl. No.: 626,430

[22] Filed: Apr. 25, 1996

[30] Foreign Application Priority Data

Apr. 25, 1995 [FR] France ..... 95 05184

[51] Int. Cl.[6] ..... E02F 3/38

[52] U.S. Cl. ..... 37/348; 414/694; 414/695.5

[58] Field of Search ..... 37/395, 348, 902, 37/903; 414/695.5, 694, 695, 696

[56] References Cited

U.S. PATENT DOCUMENTS

| | | | |
|---|---|---|---|
| 3,099,358 | 7/1963 | Clark | 414/695 X |
| 3,515,298 | 6/1970 | Guinot | 414/694 |
| 3,669,286 | 6/1972 | Gauchet | 414/694 |
| 4,571,146 | 2/1986 | Eriksson | 414/695.5 X |
| 4,650,393 | 3/1987 | Denda | 414/694 |
| 4,693,662 | 9/1987 | Haringer | 414/695.5 X |
| 5,054,990 | 10/1991 | Schaeff | 414/694 |
| 5,525,028 | 6/1996 | Ogasawara et al. | 414/694 |

FOREIGN PATENT DOCUMENTS

| | | |
|---|---|---|
| 2532671 | 9/1984 | France . |
| 2587384 | 9/1987 | France . |
| 2086347 | 5/1982 | United Kingdom . |
| 2222998 | 3/1990 | United Kingdom . |
| 9501286 | 4/1995 | WIPO . |

OTHER PUBLICATIONS

Patent Abstracts of Japan, vol. 7 No. 250 (M–254) [1935], Nov. 8, 1993.

*Primary Examiner*—Terry Lee Melius
*Assistant Examiner*—Robert Pezzuto
*Attorney, Agent, or Firm*—Harris Beach & Wilcox LLP

[57] ABSTRACT

Civil engineering apparatus that includes a turret mounted upon the chassis of a motor vehicle. A boom is pivotally mounted in the turret and is connected to a tool stick by a boom tip. Articulating members are mounted on either end of the boom stick so that each end of the boom stick can be pivotally displaced in two perpendicular planes.

3 Claims, 4 Drawing Sheets

CIVIL ENGINEERING WORKS MACHINE IN WHICH THE WORKING TOOL IS MOUNTED AT THE END OF AN ARTICULATED ARM

BACKGROUND OF THE INVENTION

The present invention relates to an improvement made to civil engineering works machines including a selfpropelled chassis on which a turret carrying working equipment is mounted.

It deals more particularly with an improvement made to machines of the type which for the subject matter of FR-A-2 532 671, and in which the working equipment has a structure such that it is possible to work just as easily as a loaded or as an excavator, simply by changing the working tool.

In the remainder of the description, the invention will be described in relation to a machine of this type, but it is quite obvious that this is not a limitation and that it could be applied to any machine in which the working tool is mounted at the end of an articulated arm.

SUMMARY OF THE INVENTION

The appended FIG. 1 diagrammatically illustrates the overall structure of such a machine used as an excavator.

Referring to this FIG. 1, the working equipment denoted by the overall reference (1) is composed of four elements which are articulated and can be deployed angularly with respect to each other, namely a boom (2), a boom tip (3), a stick (4) at the end of which the tool consisting of a bucket (5) is mounted.

This equipment is mounted on a turret (6) carried by a conventional vehicle, preferably comprising an articulated two-part chassis, the engine being mounted on the rear chassis and the driver's position and working equipment (1) themselves being mounted side by side on the turret (6) associated with the front chassis.

The various elements of the item of equipment are connected together by an articulation allowing their angular position with respect to one another to be changed about horizontal pivot axes, the dsplacement being obtained by means of rams.

In the embodiment illustrated in FIG. 1, the boom (2) is articulated with respect to the turret (6) and its position is set by the boom ram (7) by means of two arms (8, 9). The boom tip (3) is connected to the other end (10) of the boom (2) and the angular position $\alpha$ of these two elements (2, 3) is set by means of the ram (11) known as the "boom tip ram". The stick (4) is for its part articulated to the end (12) of the boom tip (3) and the angle $\beta$ between these two elements is set by means of a third ram (13) known as the "stick ram". Lastly, the bucket (5) is mounted at the end (17) of the stick (4) and its position is set by a fourth ram (15) known as the "bucket ram".

In such a system, the various rams may be controlled either individually or possibly in accordance with the teachings of PCT/FR 95/01286.

In such machines, the tool (5) is therefore displaced in space on the one hand by changing the position of the various elements forming the working equipment (i) by pivoting the articulation connecting the elements to one another and to the carrying vehicle about a horizontal axis and, on the other hand, by rotating the turret (6) which makes it possible to work just as easily along the axis of the vehicle or on either side of the latter, forming some angle.

A machine of this type is therefore designed to make it possible to carry out work while keeping the various elements of the working equipment in longitudinal alignment with one another, in one and the same vertical plane, the articulation axes being parallel to the ground and parallel to each other. By contrast, such a structure poses problems when the desire is to work offset to the side, an option which has hitherto been obtained by mounting the stick ram (13) using universal joints. Such a solution does, however, pose problems because it involves a rotational movement of the ram and therefore leads to wear thereof. In addition, when working offset to the side, the ram forms an angle with respect to the element it controls, and this leads to a reduction in its effectiveness.

Making such a lateral offset of the working tool in civil engineering works machines has been proposed for a very long time. Thus, one of the solutions proposed which is disclosed in FR-A-2 587 384 consists in displacing the whole of the item of equipment laterally by mounting it on a bracket supported in an articulated fashion by the supporting structure of the shovel and which, by means of two parallelogram arms placed side by side and laterally, allows the tool to be offset by means of a control (ram) right up to the lateral limit of the shovel or in line with this limit.

Such a solution, which at first seems attractive, cannot however be applied to multifunction machines of the aforementioned type because the boom raising system does not permit a mechanical link with the chassis.

Now, a simple and effective solution which makes it possible to solve all of the aforementioned problems has been found, and it is this that forms the subject of the present invention.

In general, the invention relates to a civil engineering works machine including:

- working equipment composed of at least three elements which are articulated together about horizontal axes and can be deployed angularly with respect to each other, the first element being articulated with respect to the chassis of the carrying vehicle, and the last element consisting of a tool;
- rams allowing the angular displacement of said elements with respect to each other to be controlled so as to position the tool at all points within the confines of a given working area.

The machine according to the invention is one wherein at least the tool stick is connected to the element preceding it via a double articulation allowing, on the one hand, angular displacement about a horizontal axis and, on the other hand, lateral angular displacement about an axis passing through a plane orthogonal to the horizontal pivot axis, this lateral displacement being controlled by means of a ram mounted laterally with respect to the support element and which causes the double articulation to pivot, the ram controlling the angular displacement about a horizontal axis of the tool stick for its part bearing on this articulation forward of the axis of lateral pivoting.

By virtue of such a structure, when the tool stick is offset laterally, the control ram which sets its angular position always remains in the same position and acts in line on the element which it displaces. As a consequence, there is no loss in effectiveness when working offset to the side.

In the case of a machine of the type which forms the subject matter of FR-A-2 532 671, and in which the working equipment is composed of four elements articulated together, the double articulation in accordance with the invention lies at least between the boom tip and the tool stick, it being possible for the articulation between the end of the boom and that of the boom tip to be a single articulation. As a preference, in such a machine, the two articulations provided at each end of the boom tip are produced in accordance with the invention, so as to be able to achieve a double offset.

DESCRIPTION OF THE DRAWINGS

The invention and the advantages which it affords will, however, be better understood by virtue of the embodiment which follows which is given by way of nonlimiting indication and is illustrated in the attached diagrams in which.

DESCRIPTION OF THE INVENTIONS

Figure 1:
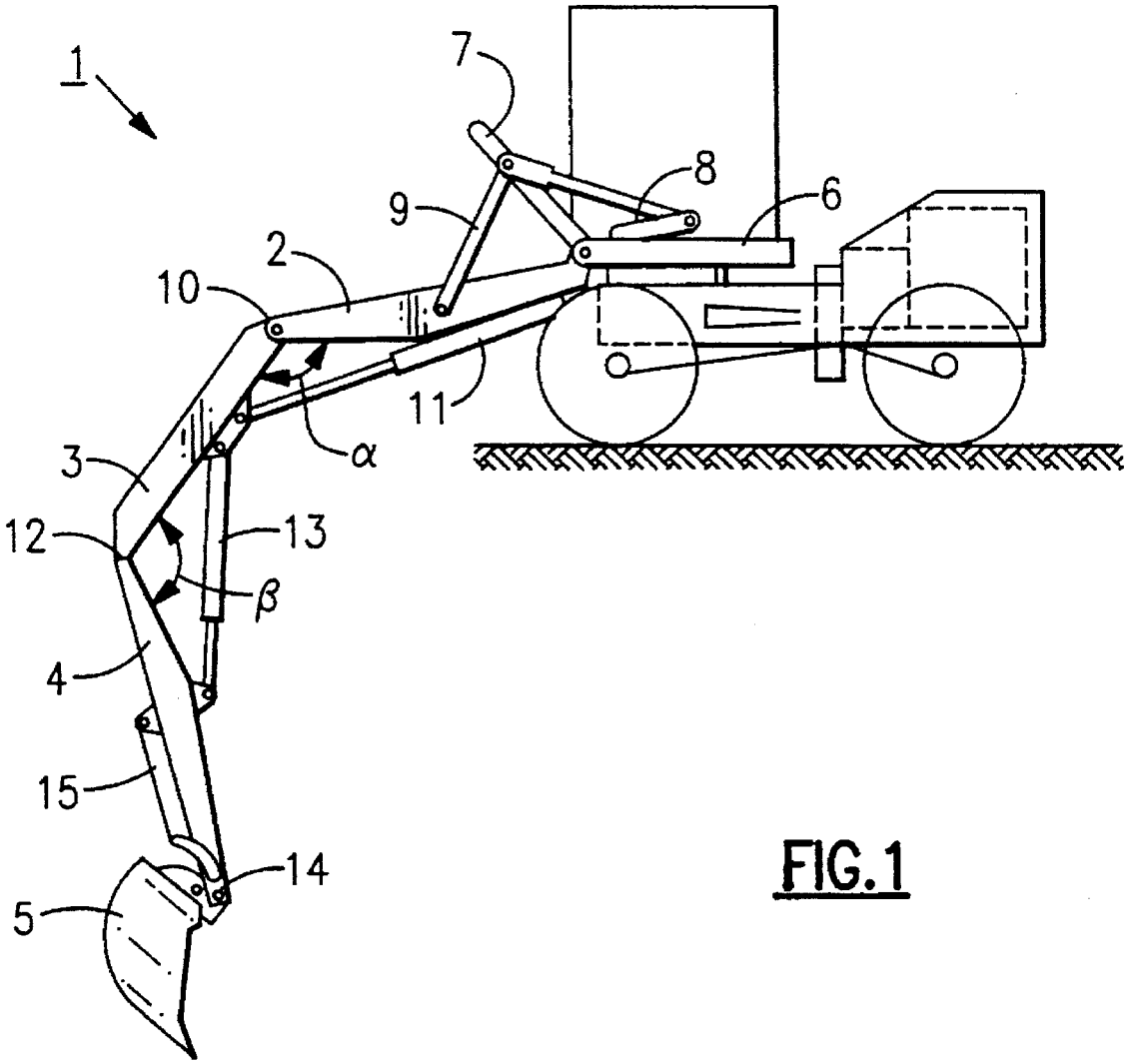
FIG. 1, as stated earlier, illustrates the prior art represented by FR-A-2 532 671.

Referring to the attached diagrams, for which the same references are used to denote elements which are in common with the prior art illustrated in FIG. 1, the machine in accordance with the invention therefore includes working equipment (1) composed of four angularly articulated elements which can be deployed with respect to each other, namely a boom (2), a boom tip (3), a stick (4) at the end of which the tool consisting of a bucket (5) is mounted.

This equipment is mounted on a turret (6) carried by a conventional vehicle.

The boom (2) is articulated with respect to the turret (6) and its position is set by the boom ram (7) by means of two arms (8, 9).

The boom tip (3) is connected to the end (10) of the boom (2) and the angular position $\alpha$ of these two elements (2, 3) is set by means of the boom tip ram. (11). The stick (4) is for its part articulated to the end (12) of the boom tip (3) and the angle $\beta$ between these two elements is set by means of a third ram (13). Lastly, the bucket (5) is mounted at the end (14) of the stick (4) and its position is set by a fourth ram (15) known as the "bucket ram".

In accordance with the invention, at least the stick (4) is connected to the element preceding it, therefore in this particular case to the boom tip (3) by means of a double articulation denoted by the overall reference (20) and which, on the one hand, allows angular displacement about the horizontal axis A and, on the other hand, allows a lateral angular displacement about an axis B passing through a plane orthogonal to the horizontal pivot axis A.

Figure 2:
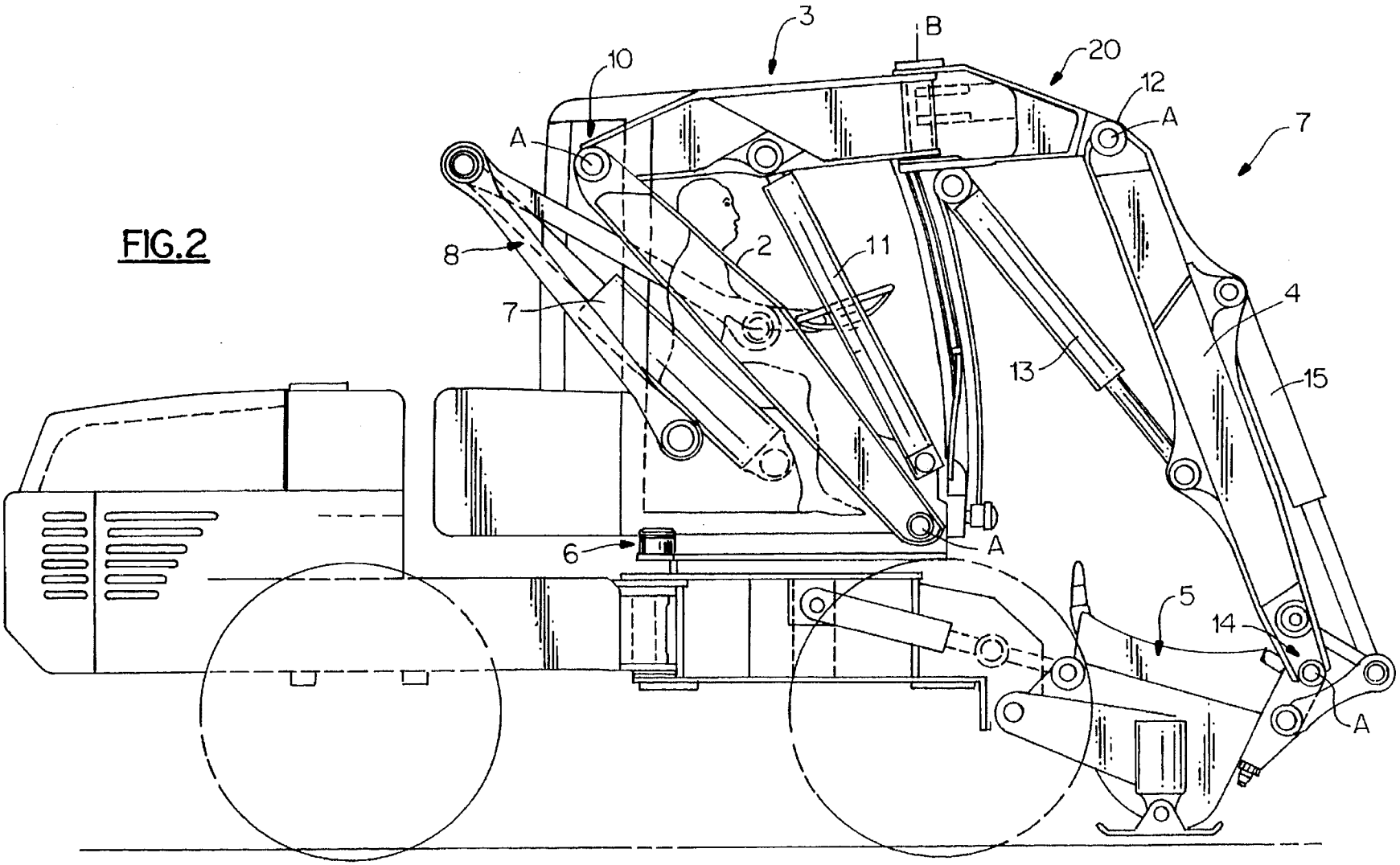
FIG. 2 illustrates an excavator loader produced in accordance with the invention, seen in side elevation, and in which the working equipment is such that a single offset of the tool stick is possible.
Figure 3:
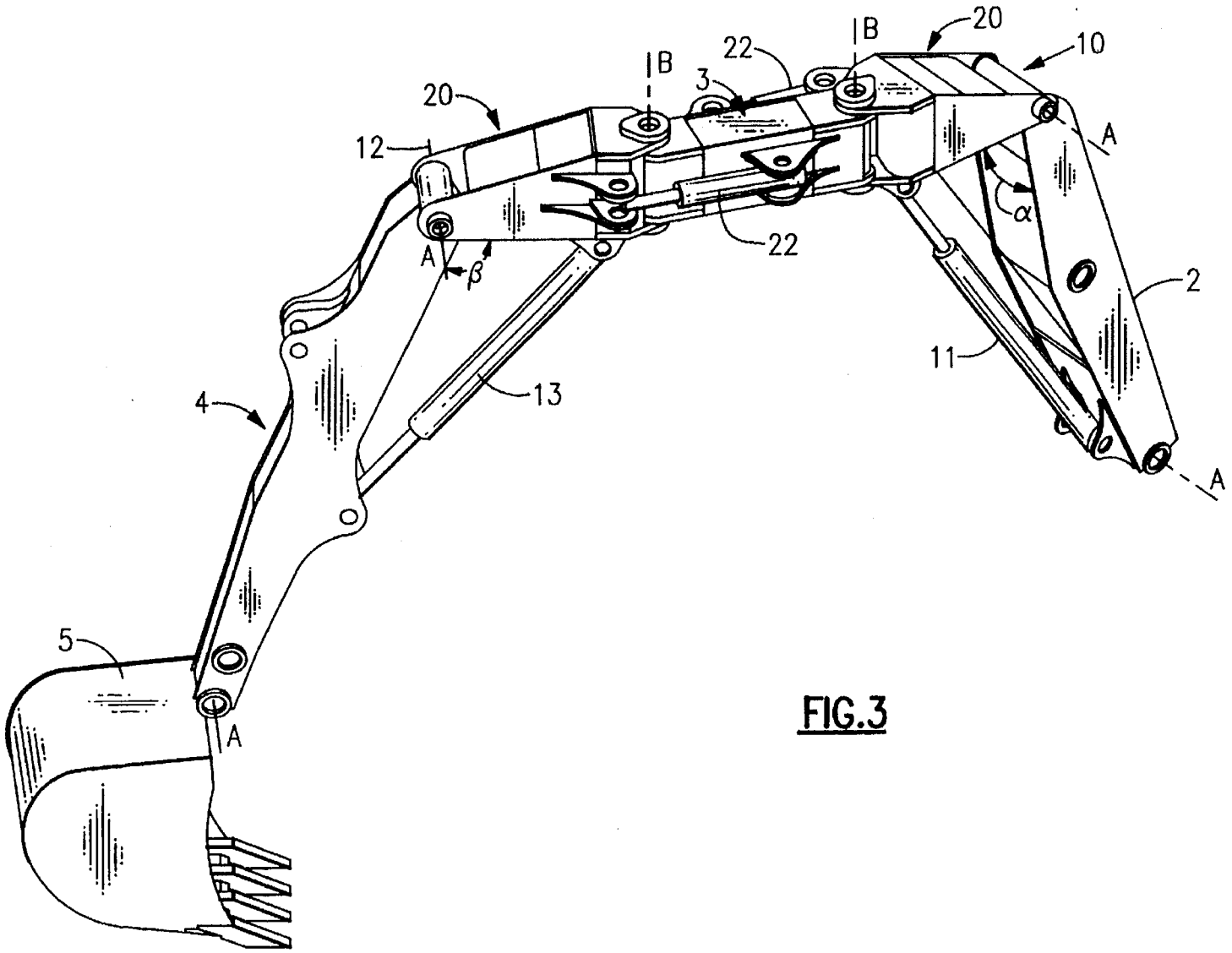
FIG. 3 is an exploded perspective detail view showing the adaptation in accordance with the invention of a working tool of an excavator loader allowing a double offset to be obtained.
Figure 5:
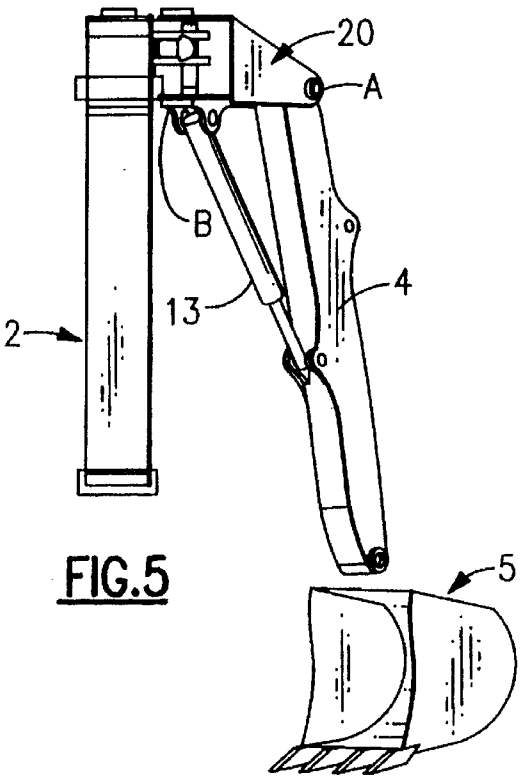
FIG. 4, 5, and 6 are respectively side elevations and a plan view of working equipment produced in accordance with the invention in the double offset position.
Figure 4:
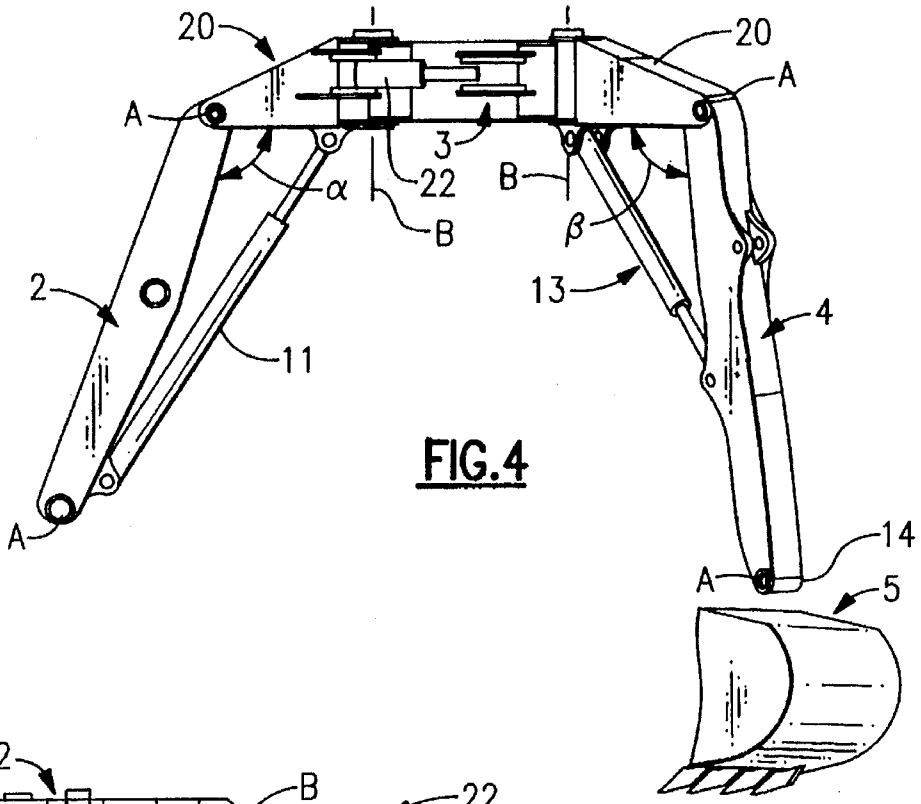
Figure 6:
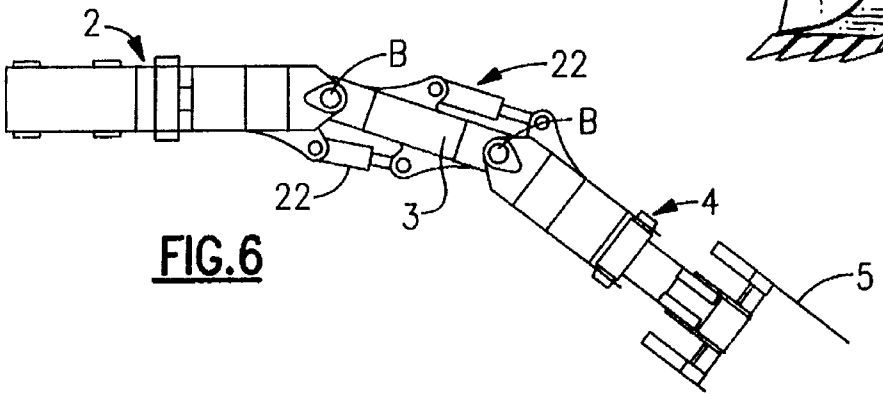

Although it is possible, as is clear from FIG. 2, to have just one double articulation (20) between the boom tip (3) and the tool stick (4), the working equipment is preferably designed in the manner illustrated in FIGS. 3 to 6 so that the link between the end (10) of the boom (2) and the end of the boom tip (3) is produced in a similar manner.

In accordance with the invention, the lateral displacement is controlled by means of a ram (22) mounted laterally with respect to the boom tip (3) and which acts on the double articulation. The rams (11, 13) controlling the angular displacements about the horizontal axes A for their part bear on the double articulation (20) forward of the axis B of lateral pivoting, which allows an in-line action even when working offset to the side.

By comparison with prior solutions making it possible to obtain a lateral offset of the working tool of a civil engineering works machine, the solution in accordance with the invention offers very many advantages among which mention may especially be made of the fact that when the machine allows a double offset, the tool (5) can have an additional angular position allowing it to circumvent obstacles.

We claim:

1. Civil engineering apparatus that includes a vehicle having a chassis, a turret mounted upon said chassis, a boom pivotally mounted at one end on said turret, a tool stick connected to the opposite end of said boom by a boom tip, said boom tip further including a body section and a first articulating member on one end of said body section and a second articulating member on the opposite end of said body member, said first articulating member having a first pivot means for connecting the boom tip to said boom so that the boom tip is pivotable about a first axis and a second pivot means for connecting the first articulating member to the body section so that the boom tip is pivotable about a second axis that is perpendicular to said first axis, said second articulating member having a third pivot means for connecting the boom tip to said tool stick so that the tool stick is pivotable about a third axis to the tool stick so a fourth pivot means for connecting the second articulating member that the tool stick is pivotable about a fourth axis that is perpendicular to said third axis, and ram means for selectively displacing the boom tip about said first and second axis and the tool stick about said third and fourth axis.

2. The apparatus of claim 1 wherein said first and third axes are in parallel alignment and second and fourth axes are in parallel alignment.

3. The apparatus of claim 2 that further includes a tool that is mounted upon one end of said tool stick.

* * * * *